US005119949A

United States Patent [19]

Kishi

[11] Patent Number: 5,119,949

[45] Date of Patent: Jun. 9, 1992

[54] CRANE VEHICLE WITH OPERATION SPEED CONTROL

[75] Inventor: Mitsuhiro Kishi, Ashikaga, Japan

[73] Assignee: Hikoma Seisakusho Co., Ltd., Japan

[21] Appl. No.: 342,120

[22] Filed: Apr. 24, 1989

[30] Foreign Application Priority Data

Feb. 13, 1989 [JP] Japan ..... 1-33292

[51] Int. Cl.[5] ..... B66C 13/16

[52] U.S. Cl. ..... 212/154; 212/149; 212/189

[58] Field of Search ..... 212/153, 154, 149, 189; 340/685, 689

[56] References Cited

U.S. PATENT DOCUMENTS

| | | | |
|---|---|---|---|
| 3,760,591 | 9/1973 | Gordon | 212/153 |
| 4,687,406 | 8/1987 | Kinsey | 212/154 |
| 4,752,012 | 6/1988 | Juergens | 212/154 |
| 4,815,514 | 3/1989 | Putkonen et al. | 212/153 |

FOREIGN PATENT DOCUMENTS

| | | | |
|---|---|---|---|
| 2587320 | 3/1987 | France | 212/154 |
| 2078197 | 1/1982 | United Kingdom | 212/149 |
| 2187432 | 9/1987 | United Kingdom | 212/153 |
| 8000268 | 2/1980 | World Int. Prop. O. | 212/153 |

*Primary Examiner*—Sherman D. Basinger
*Assistant Examiner*—Thomas J. Brahan
*Attorney, Agent, or Firm*—Bruce L. Adams; Van C. Wilks

[57] ABSTRACT

A crane vehicle has a movable vehicle body and a pair of outriggers expandable outwardly from opposite sides of the vehicle body in widthwise opposite directions and bearing against the ground to support load weight applied to the vehicle body in stationary state. A column is mounted vertically on the vehicle body and rotatable around its vertical axis. A hydraulic motor effects rotating movement of the column at variable rotation speed in clockwise and counterclockwise directions. A telescopic boom has a free top portion and a bottom portion mounted pivotably at a top portion of the column such that the telescopic boom is angularly movable along a vertical plane containing the vertical axis of the column. The telescopic boom is linearly movable along its axis. A first hydraulic cylinder effects angular movement of the telescopic boom at variable angular speed in upward and downward directions. A second hydraulic cylinder effects linear movement of the telescopic boom at variable linear speed in forward and rearward directions. A hook is disposed at the free top portion of telescopic boom for lifting a load. A pair of detectors are disposed on the pair of outriggers and operative during the rotating movement of column and the angular and linear movements of boom for detecting respective load weight components applied to the respective outriggers and for producing a control signal proportional to unbalance between the detected load weight components. A controller is responsive to the control signal for controlling the hydraulic motor and cylinders to reduce the rotation speed of column rotating movement, the angular speed of boom angular movement in the downward direction and the linear speed of boom linear movement in the forward direction when the load weight unbalance is increased.

10 Claims, 4 Drawing Sheets

CRANE VEHICLE WITH OPERATION SPEED CONTROL

BACKGROUND OF THE INVENTION

The present invention relates to a crane vehicle mounted with a crane for lifting and conveying a weight load, and more specifically relates to control of the crane operation speed in order to prevent overturn of the vehicle body.

Conventionally, the crane vehicle has been frequently used to carry a crane mounted on a body of the vehicle to a working spot, where the crane vehicle is held stationary and the crane is operated to carry out loading or unloading of a weight load. Such type of crane vehicle is provided with a plurality of outriggers expandable outwardly widthwise of the vehicle body in the opposite directions so as to bear the vehicle body against the ground during the operation of the crane in the working spot to thereby support the weight load applied to the vehicle body through the crane. The outriggers are utilized to fix the vehicle body in place and to avoid inclination and overturn of the vehicle body.

Normally, the crane is comprised of a column erected on the vehicle body and turnable around its vertical axis, and an arm pivotably mounted at its bottom end on the top of the column such that the arm undergoes angularly elevating movement, and provided at its free top end with a hook for lifting a weight load. Further, the arm is expandable linearly along its axis. By such construction, the crane can be operated to convey three dimensionally the lifted weight load around the working spot. During the three dimensional operation of crane, the center of gravity of the combined mass of vehicle body, crane and weight load is shifted according to the current position of the arm top end. Thus, if the arm top end is applied with a relatively heavy load and is operated to reach far away from the vehicle body center, the center of gravity of the combined mass may be deviated beyond the span of the outriggers, to thereby cause inclination and overturn of the vehicle body.

In view of the above described possibility of inclination and overturn, some types of crane vehicles are provided with a sensor for monitoring unbalance of the weight load components applied between opposite sides of the vehicle body to stop the operation of crane or to produce an alarm signal when the monitored unbalance exceeds a preset critical amount. However, such a simple control system is not practically effective to perfectly prevent overturn of the vehicle body under various conditions of crane operation and various circumstances of working spots. The vehicle body might overturn due to a sudden stop operation of the crane. The vehicle body might overturn before the monitored unbalance exceeds the preset critical amount under the worst condition and circumstance. The operator might ignore the alarm signal.

SUMMARY OF THE INVENTION

An object of the present invention is to ensure the prevention of vehicle body overturn perfectly under various crane operation conditions and various working spot circumstances.

Another object of the present invention is to control the operation speed of a crane according to the monitored unbalance of load weight components between the opposite sides of a vehicle body.

A further object of the present invention is to reduce concurrently the turning speed of the crane column, angularly descending speed of the crane arm and linearly expanding speed of the crane arm according to the monitored load weight unbalance.

DETAILED DESCRIPTION OF EMBODIMENTS

Figure 1:
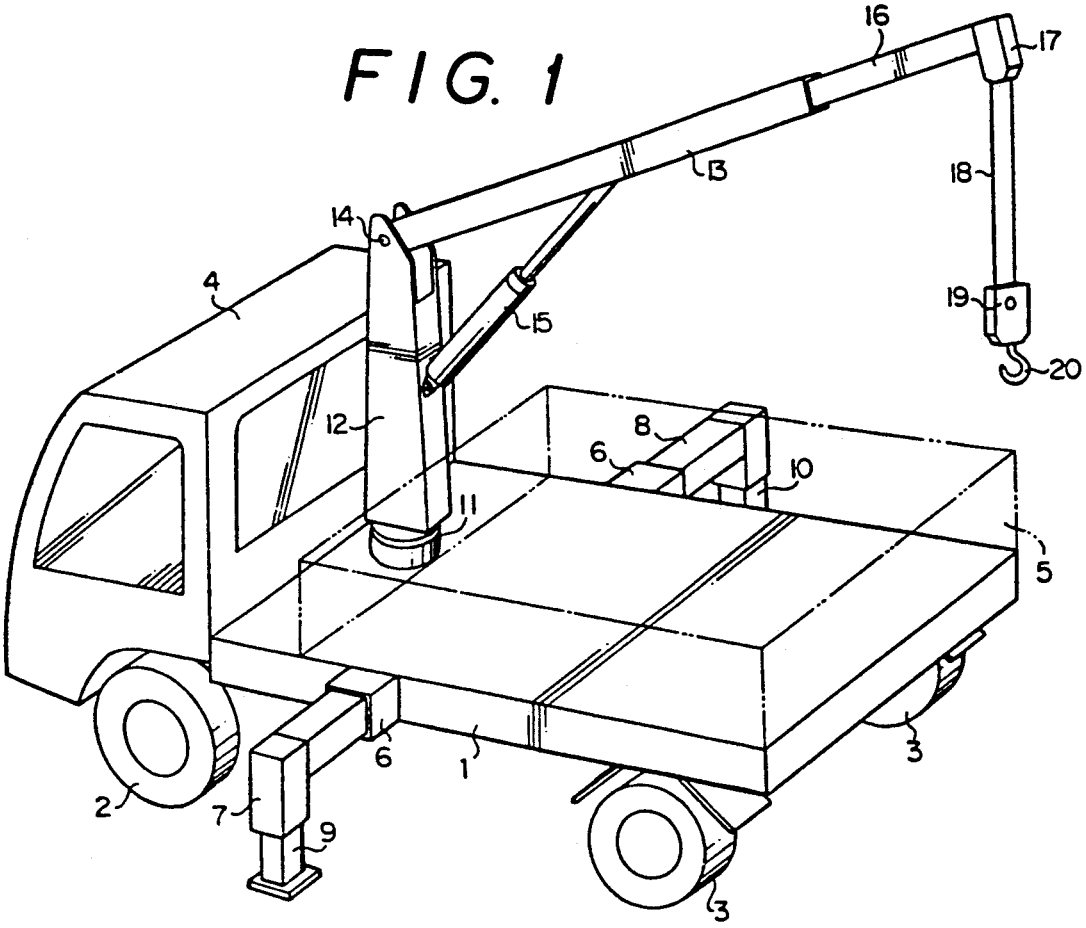
FIG. 1 is a perspective view of a crane vehicle according to the present invention.

Hereinafter, embodiments of the present invention will be described in detail in conjunction with the attached drawings. FIG. 1 shows a crane vehicle in which a crane is mounted on a driveable truck. A vehicle body 1 is provided at its front and rear side portions with a pair of front drive wheels 2 and a pair of rear drive wheels 3, which are rotationally supported on opposite sides of the body 1 so that the crane vehicle can travel to a desired working spot. A cabin 4 is mounted on the front part of body 1 to accommodate therein an operator, and a cargo box 5 is provided on the rear part of the vehicle body 1. The vehicle body 1 is provided with a supporting device for supporting the vehicle body 1 in place during the operation of crane in the stationary state of body. The supporting device is comprised of a hollow guide member 6 disposed widthwise of the vehicle body 1 in the middle part of the body 1 and having opposed openings at opposite sides of the body 1. A pair of outriggers 7 and 8 are slidably inserted into the hollow guide member 6 through the corresponding opposed openings and are expandable outwardly widthwise of the vehicle body 1 when the vehicle is in the stationary state. The outrigger 7 has at its free end a hydraulic leg 9 expandable downward to bear against the ground to support a load weight component applied thereto, and the other outrigger 8 has also at its free end another hydraulic leg 10 expandable downward to bear against the ground to support another load weight component applied thereto.

A crane is mounted on the vehicle body 1 between the cabbin 4 and the cargo box 5. The crane is comprised of a turn table 11 mounted on the vehicle body 1 rotatably around its vertical axis and driven by a hydraulic motor (not shown) in clockwise and counterclockwise directions at a variable rotation speed, a crane column 12 mounted vertically at its bottom on the turn table 11 for rotating movement therewith around the vertical axis, and a crane arm mounted pivotably at its bottom end on the top of crane column 12 such that the crane arm is angularly movable in upward and downward directions along a vertical plane containing the axis of column.

The crane arm is composed of a telescopic boom having a bottom boom member 13 of hollow rectangular section mounted on the top of the crane column 12 pivotably around a pivot pin 14. A hydraulic cylinder 15 is interposed between the crane column 12 and the bottom boom member 13 to drive the same so as to effect the angular movement of the crane arm in the upward and downward directions at variable angular speed. A top boom member 16 is slidably inserted into the bottom boom member 13 through the top opening of bottom boom member 13. A head 17 is fixed to the free top end of top boom member 16. The head 17 has suspending wires 18 extending downwardly from the head 17. A hook body 19 is engaged with the free end of suspending wires 18 and wound up and down by the suspending wires 18. A hook element 20 is connected to the bottom of hook body 19 to lift a weight load.

Figure 2:
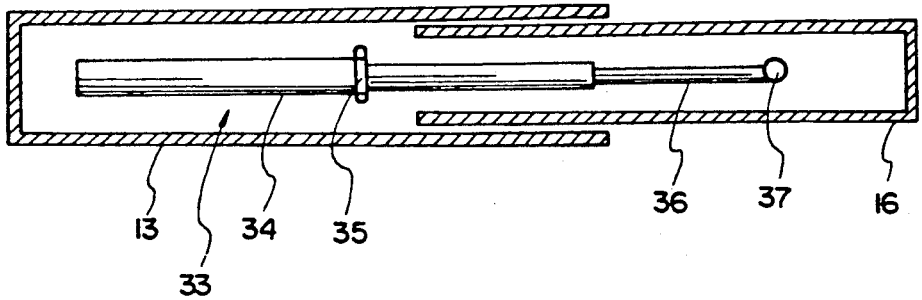
FIG. 2 is a longitudinal sectional view of a telescopic boom of the crane shown in FIG. 1.

FIG. 2 shows a longitudinal section of the telescopic boom. A hydraulic cylinder 33 is disposed inside the hollow telescopic boom. A case 34 of the hydraulic cylinder 33 is fixed to the inside of bottom boom member 13 by means of a hinge plate 35, and a slidable shaft 36 of the hydraulic cylinder 33 is fixed to the inside of top boom member 16 by means of a bolt 37. The hydraulic cylinder 33 is hydraulicly operated to drive the telescopic boom to effect the linear expanding and contracting movement of crane arm in forward and rearward directions at variable linear speed.

Figure 3:
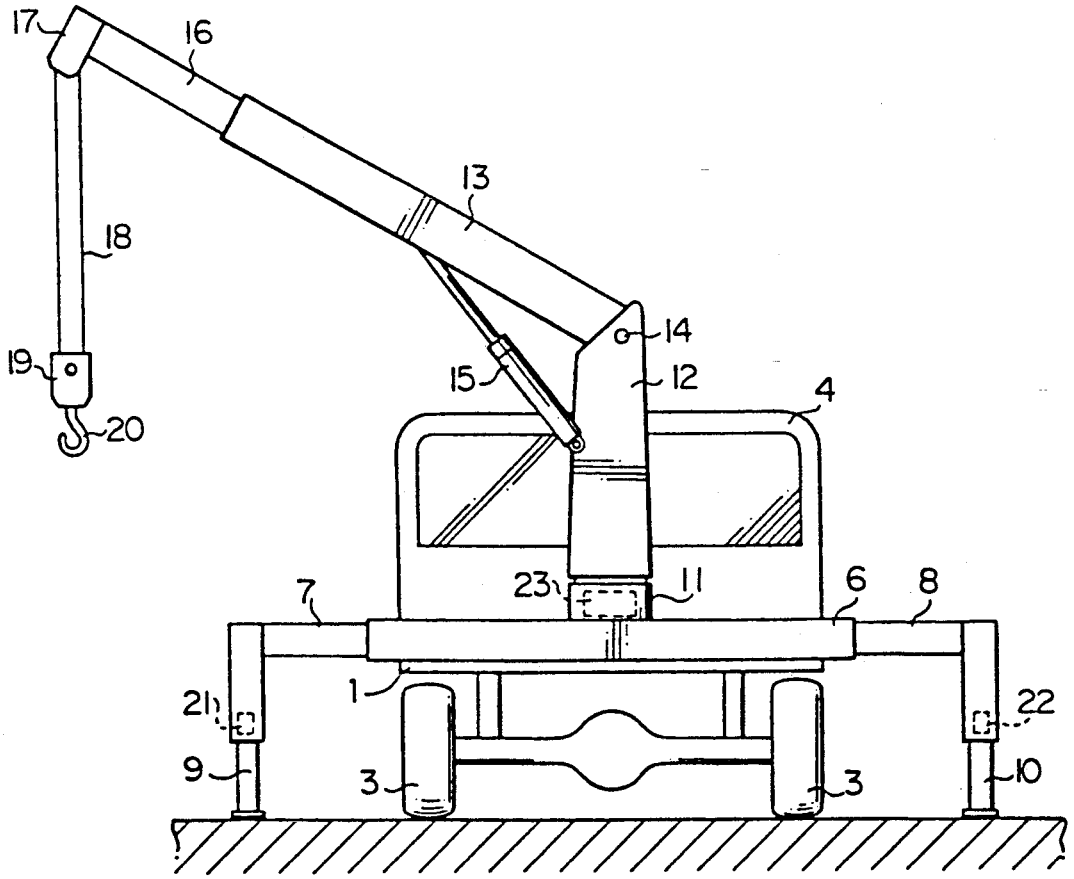
FIG. 3 is a rear view of the FIG. 1 crane vehicle.

FIG. 3 shows a rear view of the crane vehicle shown in FIG. 1. A sensor 21 is attached to the hydraulic leg 9 to detect the load weight component applied to the hydraulic leg 9, and another sensor 22 is attached to the other hydraulic leg 10 to detect the other load weight component applied to the hydraulic leg 10 during the operation of the crane such that the pair of sensors 21 and 22 can continuously monitor the load weight unbalance between the opposite sides of vehicle body 1, indicative of shift or deviation in the center of gravity of the entire mass including the lifted load weight. In addition, the hydraulic motor 23 is disposed inside the turn table 11 to turn or rotate the crane column 12 around its vertical axis.

Figure 4A:
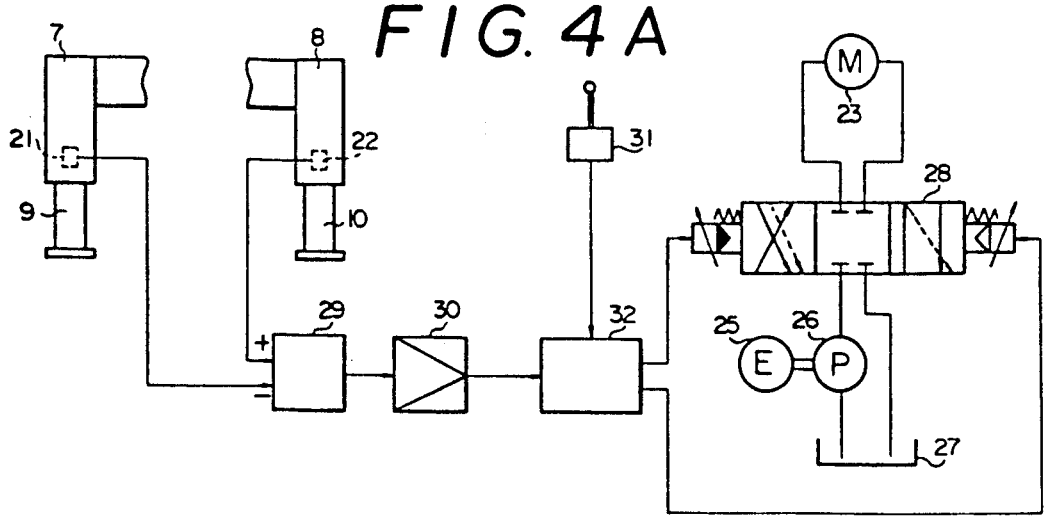
FIG. 4A is a block diagram showing a control system of a crane column turning driver.
Figure 6:
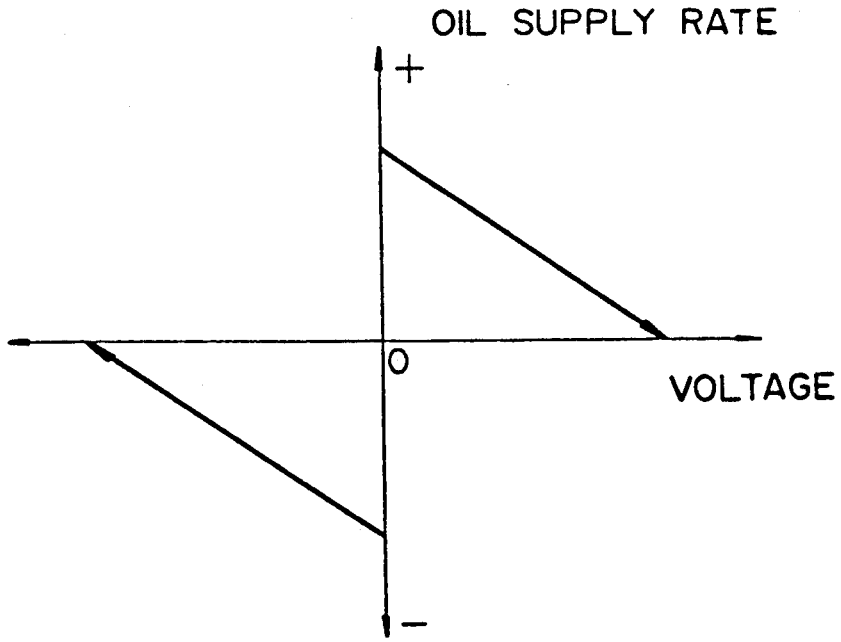
FIG. 6 is a diagram showing the relation between oil supply rate to hydraulic driver and control voltage.

FIG. 4A is a block diagram showing a rotational control system comprised of hydraulic and electric parts for the hydraulic motor 23 to regulate the rotating speed of turning movement of crane column. A hydraulic pump 26 is driven by a vehicle engine 25, and is hydraulically connected at its inlet port to an oil tank 27 and hydraulically connected at its outlet port to an electromagnetic control valve 28 to supply thereto pressurized oil. The electromagnetic valve 28 is hydraulically connected to the hydraulic motor 23 to bidirectionally supply thereto the pressurized oil to effect the bidirectional rotation. As shown in FIG. 6, the electromagnetic control valve 28 is operated to regulate the rate of pressurized oil supplied to the hydraulic motor 23 in response to a rotational control voltage signal applied to a pair of control terminals of the valve 28. In this embodiment, the pressurized oil supply rate is negatively proportional to the control voltage signal. More specifically, with increase in the absolute magnitude of the control voltage signal, the pressurized supply rate is reduced to thereby reduce the rotation speed of hydraulic motor 23 in the clockwise and counterclockwise directions.

Figure 5:
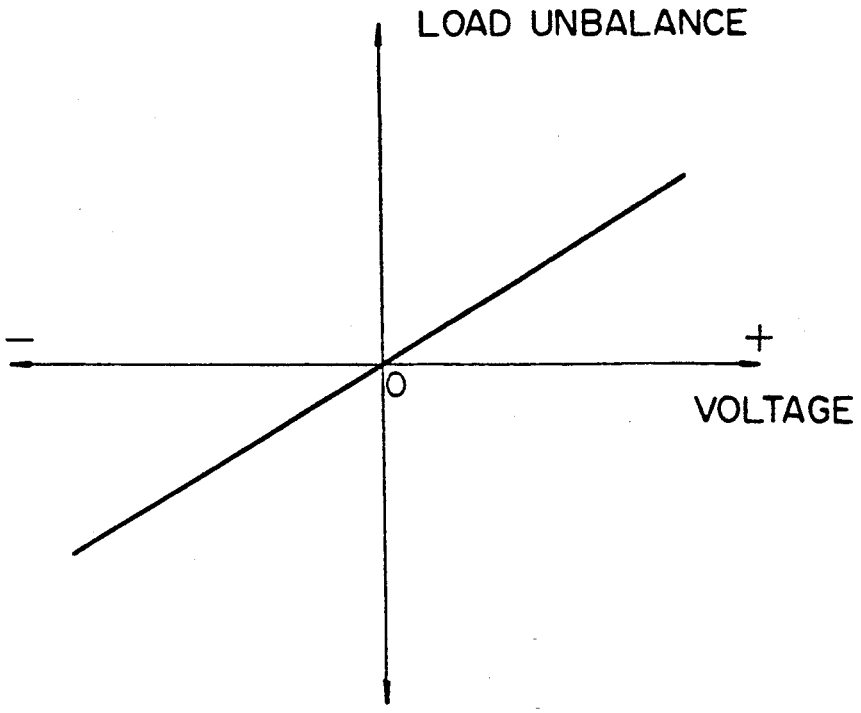
FIG. 5 is a diagram showing the relation between monitored load unbalance and control voltage.

Next, the electric part of the control system is comprised of the pair of sensors 21 and 22 for outputting detection signals, respectively, indicative of the magnitudes of respective load weight components corresponding to the weight distribution of the lifted load. A comparator 29 receives the detection signals and compares them to each other to output a differential signal indicative of the difference between the magnitudes of respective load weight components and therefore, as shown in FIG. 5, indicative of unbalance of the load weight due to the three dimensional operation of the crane. An amplifier 30 is connected to the comparator 29 to amplify the differential signal. A manual operating device 31 is disposed inside the vehicle cabin and manually operated to produce operating signals including a rotational direction signal indicative of the rotational direction of the crane column, an angular direction signal indicative of the angular direction of the crane arm ascending and descending movement, and a linear direction signal indicative of the linear direction of the crane arm expanding and contracting movement.

A rotation control circuit 32 receives the amplified differential signal and the rotational direction signal to output the above mentioned rotation control voltage signal to the control valve 28. The control voltage signal has a polarity according to the rotational direction signal to effect selectively the clockwise or counterclockwise rotation of the crane column 12, and has a voltage amplitude proportional to the magnitude of the differential signal to thereby effect the reduction of rotational speed of the crane column when the magnitude of the differential signal and therefore the degree of load weight unbalance is increased according to the characteristic curve of FIG. 6.

Figure 4B:
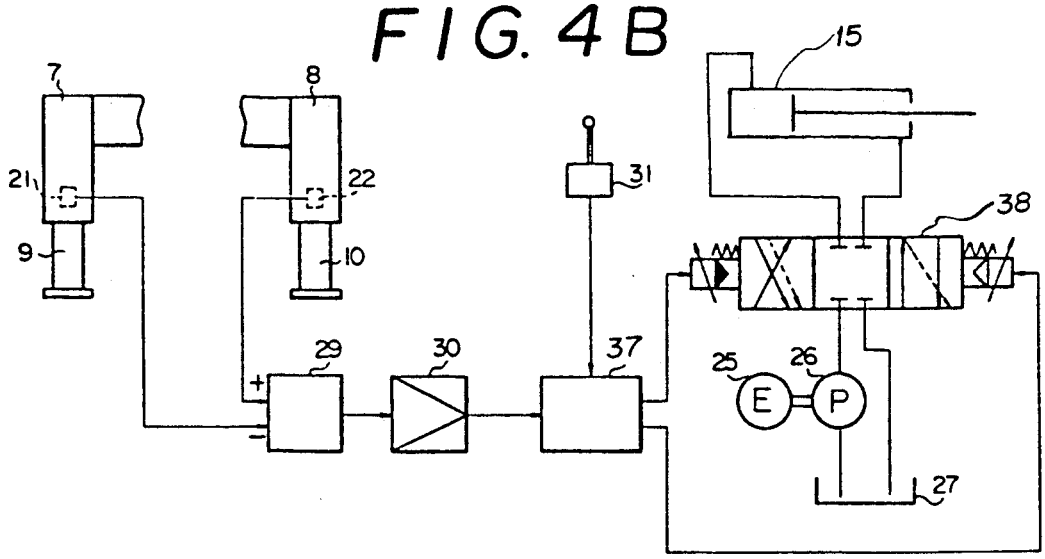
FIG. 4B is a block diagram showing a control system of a crane arm angular elevating driver.

FIG. 4B is a block diagram showing an angular control system for the hydraulic cylinder 15 to regulate the angular speed of angularly descending movement of the crane arm. The components are common to those of the rotational control system of FIG. 4A except an angular control circuit 37 and an electromagnetic control valve 38. The angular control circuit 37 receives the amplified differential signal from the common amplifier 30 and the angular direction signal from the common operating device 31 to output an angular control voltage signal to the specific control valve 38. The angular control voltage signal has either of the positive and negative polarities according to the angular direction signal to effect selectively the angularly ascending or descending movement of the crane arm. However, the differential signal inputted into the angular control circuit 37 is enabled during the descending movement of the crane arm such that the angular control signal has a variable amplitude proportional to the differential signal during the angularly descending movement of the crane arm The specific control valve 38 is hydraulically connected between the common pump 26 and the hydraulic cylinder 15 to regulate the oil supply rate in response to the angular control voltage signal according to its oil supply rate v.s. control voltage relation similar to that of control valve 28 shown in FIG. 6. Thus, the control valve 38 operates to reduce the angular speed of the crane arm descending movement when the magnitude of the differential signal and therefore the degree of load unbalance is increased. It is important to reduce the angular speed of crane arm descending movement, because such movement always tends to increase the load weight unbalance and therefore to increase the risk of vehicle body overturn.

Figure 4C:
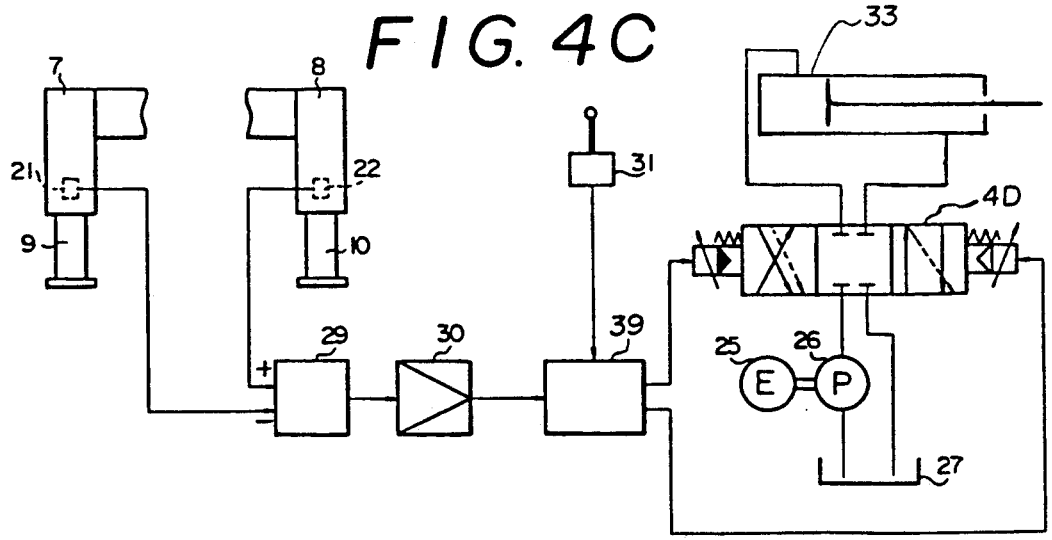
FIG. 4C is a block diagram showing a control system of a crane arm linear driver.

FIG. 4C is a block diagram showing a linear control system for the hydraulic cylinder 33 to regulate the linear speed of expanding movement of crane arm. The components thereof are common to those of the rotational control system shown in FIG. 4A except a linear control circuit 39 and a specific electromagnetic control valve 40. The linear control circuit 39 receives the amplified differential signal from the common amplifier 30 and the linear direction signal from the common operating device 31 to output a linear control voltage signal to the specific control valve 40. The linear control voltage signal has likewise either of the positive and negative polarities according to the linear direction signal to effect selectively the expanding and contracting movements of the crane arm. However, the differential signal inputted into the linear control circuit 39 is enabled during the expanding movement of the crane arm such that the linear control signal has a variable amplitude proportional to the differential signal during the linearly expanding movement of the crane arm.

The specific control valve 40 is hydraulically connected between the common hydraulic pump 26 and the hydraulic cylinder 33 to regulate the pressurized oil supply rate to the hydraulic cylinder 33 in response to the linear control voltage signal according to its conversion characteristic between the oil supply rate and the control voltage similar to that of control valve 28 shown in FIG. 6. Thus, the control valve 40 operates to reduce the expanding speed of the crane arm when the magnitude of the differential signal and therefore the degree of load unbalance is increased. It is important to reduce the expanding speed of crane arm expanding movement, because such movement always tends to increase the load weight unbalance and therefore to increase the risk of vehicle body overturn.

Lastly, operation of the crane vehicle will be explained hereinafter. Firstly, the pair of outriggers 7 and 8 are expanded in the widthwise opposite directions from the guide member 6, to reach the farmost positions from the opposite sides of vehicle body 1. Then, the pair of hydraulic legs 9 and 10 are expanded downwardly to bear against the ground and to lift the vehicle body 1 upwardly relative to the ground to avoid unstable movement of body 1 due to its suspension spring etc.

Thereafter, the operating device 31 is operated manually so as to actuate the hydraulic motor 23, hydraulic cylinder 15 and hydraulic cylinder 33 to rotate the crane column, to angularly move the crane arm and to linearly move the crane arm to displace the hook body 19 around a weight load to be lifted. Then, the weight load is lifted by means of the hook element 20, and the crane is operated to convey the lifted weight load to a destined point to thereby carry out the loading or unloading of the weight load to and from the cargo box 5 on the vehicle body 1.

During the operation of the crane, the pair of sensors 21 and 22 continuously monitor the load weight components applied to the respective hydraulic legs 9 and 10. The corresponding detection signals are fed to the comparator 29. The comparator 29 produces the differential signal indicative of the difference between the respective load weight components and therefore indicative of unbalance of load weight between the opposite sides of vehicle body 1. The differential signal is then amplified by the amplifier 30 and thereafter fed to the three control circuits 32, 37 and 39 in parallel relation.

By manipulating the operating box or device 31, the rotational direction signal is fed to the rotational control circuit 32 to actuate the corresponding electromagnetic bidirectional control valve 28 in either direction according to the rotational direction signal. By this actuation, the pressurized oil is supplied from the hydraulic pump 26 to the hydraulic motor 23 through the bidirectional valve 28 to drive the hydraulic motor 23 to thereby selectively rotate the crane column 12 in either of clockwise and counterclockwise directions about its vertical axis.

During the rotation of crane column 12, the pair of pressure sensors 21 and 22 monitor the load weight unbalance between the opposite sides of vehicle body, which could increase when an excessive weight load lifted by the crane is conveyed away from the widthwise center line of vehicle body or when one of the hydraulic legs sinks into the soft ground. The rotation control circuit 32 receives the differential signal indicative of such load weight unbalance to control the valve 28 in response to the load weight unbalance.

Accordingly, when the load weight unbalance is zero or very small, the control valve 28 regulates the oil supply rate to drive the hydraulic motor 23 at the normal constant speed. However, when the load weight becomes great, the control valve 28 regulates to reduce the pressurized oil supply rate so as to reduce the rotation speed of hydraulic motor 23 and to reduce the rotation speed of the crane column 12. The more the load weight unbalance monitored by the sensors 21 and 22, the smaller the rotation speed of the crane column 12. By such control, the destructive overturn of vehicle body 1 can be effectively avoided before the unbalance exceeds the critical level and the operator can recognize the approaching dangerous condition through the reduction of crane column rotation speed as compared to the normal speed.

Simultaneously to the reduction of crane column rotation speed, the angularly descending speed and the linearly expanding speed of the crane arm are also reduced when the load weight unbalance increases so as to perfectly avoid possible overturn of vehicle body 1. By manipulating the operating device 31, the angular direction signal is fed to the angular control circuit 37 to actuate the corresponding electromagnetic bidirectional control valve 38 in either direction. By this actuation, the pressurized oil is supplied from the hydraulic pump 26 to the hydraulic cylinder 15 through the bidirectional valve 38 to drive the hydraulic cylinder 15 in either direction to thereby selectively ascend or descend the crane arm in an angularly upward or downward direction.

However, in the angular control circuit 37, the differential signal inputted thereinto from the amplifier 30 is enabled during the descending movement of the crane arm. Therefore, during the descending movement, when the load weight unbalance is increased, the angular control circuit 37 operates to reduce the oil supply rate to the hydraulic cylinder 15 to thereby reduce the angular speed of the crane arm descending movement. By such operation, the possible overturn due to load weight unbalance can be effectively avoided.

In similar manner, by manipulating the operating device 31, the linear direction signal is fed to the linear control circuit 39 to actuate the corresponding electromagnetic bidirectional control valve 40 in either direction. By this actuation, the pressurized oil is supplied from the hydraulic pump 26 to the hydraulic cylinder 33 through the bidirectional valve 40 to drive the hydraulic cylinder 33 in either direction to thereby selectively expand or contract the telescopic boom.

However, in the linear control circuit 39, the differential signal inputted thereinto from the amplifier 30 is enabled during the expanding movement of the crane arm. Therefore, during the expanding movement, when the load weight unbalance is increased, the linear control circuit 39 operates to reduce the oil supply rate to the hydraulic cylinder 33 to thereby reduce the expanding speed of the crane arm. By concurrently effecting the reductions in the crane column rotation speed, the crane arm angularly-descending speed and the crane arm expanding speed, the possible overturn of vehicle body can be perfectly avoided.

What is claimed is:

1. A crane vehicle comprising: a movable vehicle body; a pair of support means expandable outwardly from opposite sides of the vehicle body in widthwise opposite directions and bearing against the ground to support a load weight applied to the vehicle body when in a stationary state; column means mounted vertically on the vehicle body and rotatable around its vertical axis; rotary drive means for effecting rotating movement of the column means at a variable rotation speed in clockwise and counterclockwise directions; arm means having a free top portion and a bottom portion mounted pivotably at a top portion of the column means such that the arm means is angularly movable along a vertical plane containing the vertical axis of the column means, the arm means being linearly movable along its axis; angular drive means for effecting angular movement of the arm means at a variable angular speed in upward and downward directions; linear drive means for effecting linear movement of the arm means at a variable linear speed in forward and rearward directions; lifting means disposed at the free top portion of the arm means for lifting a load; a pair of detecting means disposed on the pair of supporting means and operative during the rotating movement of the column means and the angular and linear movements of the arm means for detecting respective load weight components applied to the respective supporting means for producing a control signal proportional to unbalance between the detected load weight components; and control means responsive to the control signal for controlling the rotary, angular and linear drive means to reduce the rotation speed of column means rotating movement, the angular speed of arm means angular movement in the downward direction and the linear speed of arm means linear movement in the forward direction when the load weight unbalance is increased so as to avoid overturn of the vehicle body.

2. A crane vehicle according to claim 1; wherein the pair of support means comprise a pair of outriggers having at their respective free ends hydraulic legs for fixing the vehicle body in place.

3. A crane vehicle according to claim 1; wherein the arm means comprises a telescopic boom expandable in the forward direction and contractable in the rearward direction.

4. A crane vehicle according to claim 1; wherein the rotary drive means comprises a hydraulic motor disposed between the bottom portion of the column means and the vehicle body, the angular drive means comprises a hydraulic cylinder interposed between the column means and the arm means to angularly elevate and lower the arm means, and the linear drive means comprises another hydraulic cylinder disposed along the arm means to linearly move the top portion thereof relative to the bottom portion thereof.

5. A crane vehicle according to claim 4; wherein the control means includes valve means for regulating the flow rate of hydraulic fluid to the hydraulic motor and cylinders to thereby control the rotation speed of column means rotating movement, the angular speed of arm means angular movement and the linear speed of arm means linear movement.

6. A crane vehicle according to claim 1; including manual operating means for operating the rotary, angular and linear drive means to effect cooperative rotating movement of the column means, angular movement of the arm means and linear movement of the arm means, and for enabling the control means during the rotating movement in the clockwise and counterclockwise directions, during the angular movement in the downward direction and during the linear movement in the forward direction.

7. A crane vehicle comprising: a crane column mounted to undergo rotational displacement about its vertical axis; rotary drive means for rotationally displacing the crane column at a variable speed; a crane arm mounted at one end on the crane column to undergo ascending and descending angular displacement relative to the crane column, the crane arm being lengthwise extendable and retractable along its axis and having lifting means at the distal end thereof for lifting a load; angular drive means for angularly displacing the crane arm in ascending and descending directions at a variable speed; linear drive means for linearly extending and retracting the crane arm at a variable speed; detecting means for detecting the weight distribution of the lifted load at spaced-apart points on opposite widthwise sides of the crane vehicles and producing corresponding detection signals; circuit means receptive of the detection signals for developing therefrom a control signal proportional to the degree of unbalance of the detected weight distribution at the points of detection; and control means responsive to the control signal for controlling at least one of the rotary, angular and linear drive means to reduce at least one of the speed of rotation of the crane column, the speed of angular descending displacement of the crane arm and the speed of extension of the crane arm in accordance with an increase in the unbalance of the detected weight distribution.

8. A crane vehicle according to claim 7; wherein the control means comprises means responsive to the control signal for controlling each of the rotary, angular and linear drive means to reduce the speed of rotation of the crane column, the speed of angular descending displacement of the crane arm and the speed of extension of the crane arm in accordance with an increase in the unbalance of the detected weight distribution.

9. A crane vehicle according to claim 8; wherein the control means includes means for reducing the aforesaid speeds as a linear function of the increase in the unbalance of the detected weight distribution.

10. A crane vehicle according to claim 8; wherein the rotary, angular and linear drive means comprise fluid motors; and the control means comprises valve means responsive to the control signal for controlling the flow rate of pressurized fluid to the fluid motors.

* * * * *